US006956533B2

(12) United States Patent
Lindenmeier

(10) Patent No.: US 6,956,533 B2
(45) Date of Patent: Oct. 18, 2005

(54) ANTENNA HAVING A MONOPOLE DESIGN, FOR USE IN SEVERAL WIRELESS COMMUNICATION SERVICES

(75) Inventor: Heinz Lindenmeier, Plunegg (DE)

(73) Assignee: FUBA Automotive GmbH &Co. KG, Bad Salzdetfurth (DE)

( * ) Notice: Subject to any disclaimer, the term of this patent is extended or adjusted under 35 U.S.C. 154(b) by 55 days.

(21) Appl. No.: 10/773,736

(22) Filed: Feb. 6, 2004

(65) Prior Publication Data

US 2004/0160373 A1 Aug. 19, 2004

(30) Foreign Application Priority Data

Feb. 6, 2003 (DE) ..... 103 04 909

(51) Int. Cl.[7] ..... H01Q 9/00
(52) U.S. Cl. ..... 343/749; 343/713; 343/752
(58) Field of Search ..... 343/704, 711, 343/712, 713, 722, 749, 752

(56) References Cited

U.S. PATENT DOCUMENTS 3,299,428 A * 1/1967 Tessari, III ..... 343/743
4,313,121 A * 1/1982 Campbell et al. ..... 343/790
5,233,362 A * 8/1993 Villaseca et al. ..... 343/712
6,218,997 B1 4/2001 Lindenmeier et al. ..... 343/725
6,606,057 B2 * 8/2003 Chiang et al. ..... 342/374
6,653,982 B2 11/2003 Lindenmeier et al. ..... 343/741

* cited by examiner

*Primary Examiner*—Tho Phan
(74) *Attorney, Agent, or Firm*—Collard & Roe, P.C.

(57) ABSTRACT

A monopole antenna for use with at least two wireless communication services, having a monopole element (10) disposed along a straight line (11) and connected with a roof capacitor (1) that is designed as a flat area, the area normal line (12) pointing in the direction of the straight line (11). The roof capacitor (1) has rotational symmetry, and is formed by flat ring structures (2) that are separated from one another by ring-shaped gaps (3), the structures being oriented concentric to the straight line (11). Reactance circuits (4) connect the ring structures (2) with one another so that they are active for a wireless communication service having the lowest frequency, and the outermost ring structure (2) is essentially ineffective for the wireless communication service having the next higher frequency, because of the high impedance of the reactance circuit (4). Likewise, at the higher frequency of the wireless communication services, the outermost ring of the active ring structures (2), connected with one another by means of low impedance reactance circuits (4), is designed to be smaller.

10 Claims, 9 Drawing Sheets

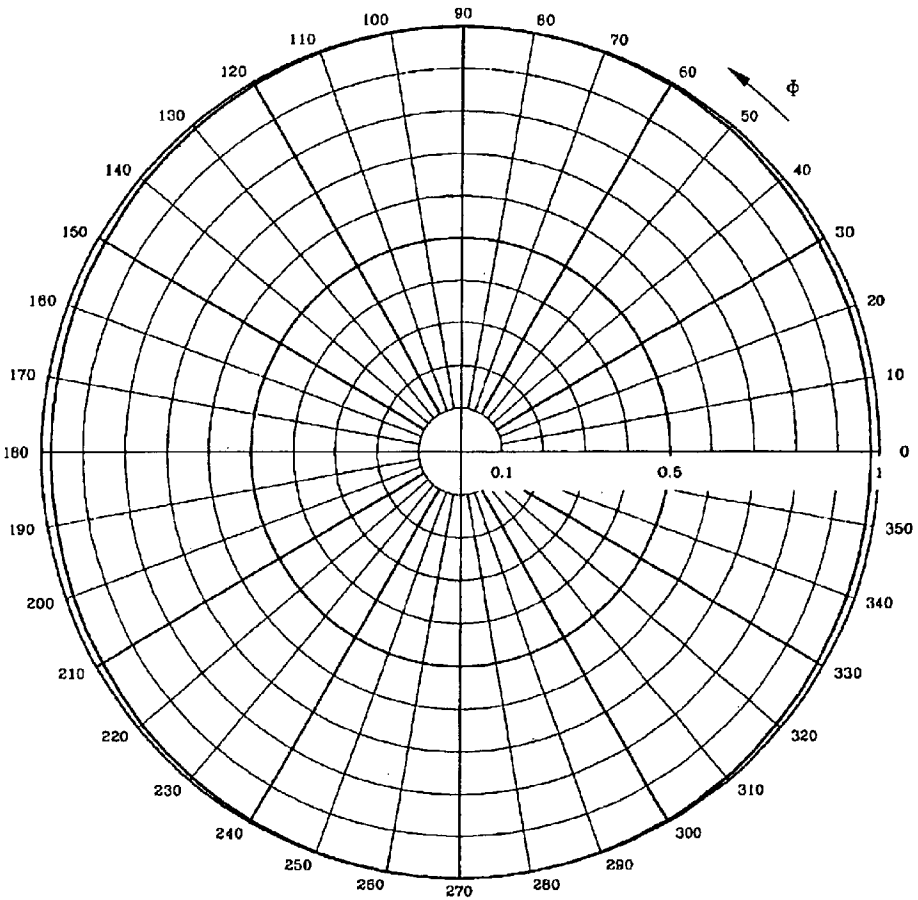
Fig. 6a: Horizontal diagram of an antenna embodiment according to the invention, according to Fig. 5, at 2300 MHz

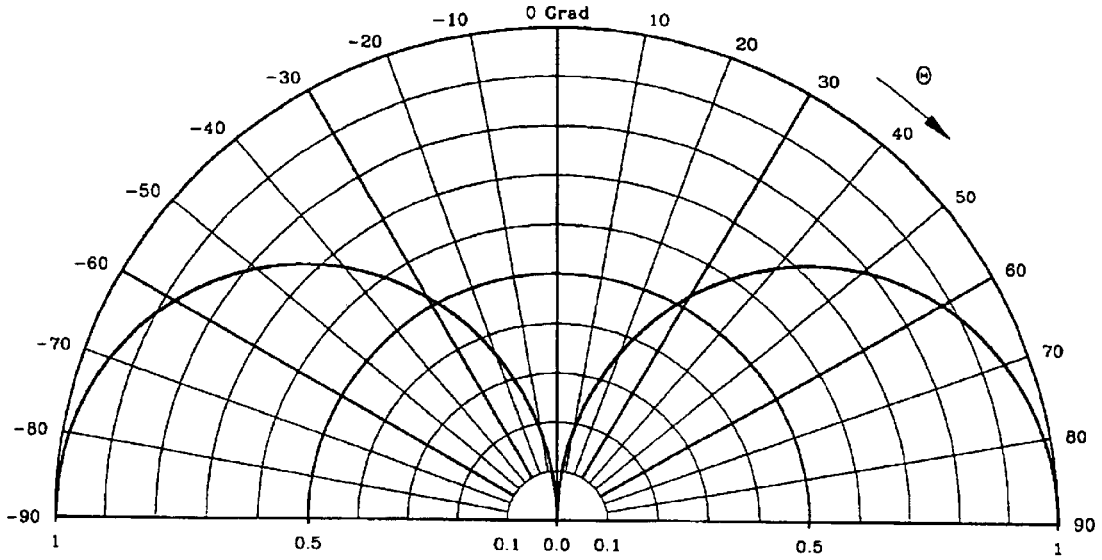
Fig. 6b: Vertical directional diagram of the antenna according to Fig. 5 at 2200 MHz
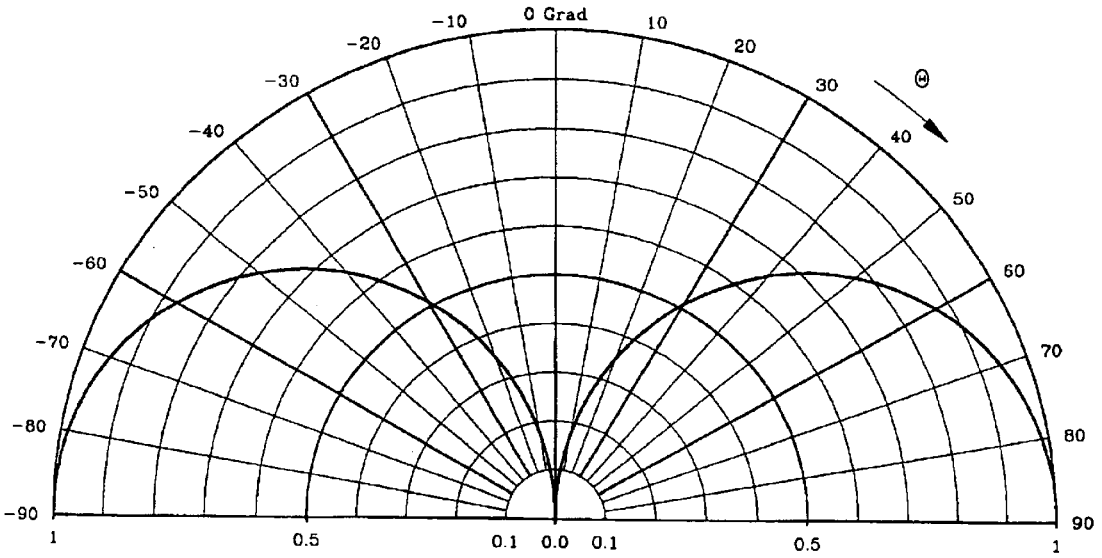
Fig. 6c: Vertical directional diagram of the antenna according to Fig. 5 at 960 MHz

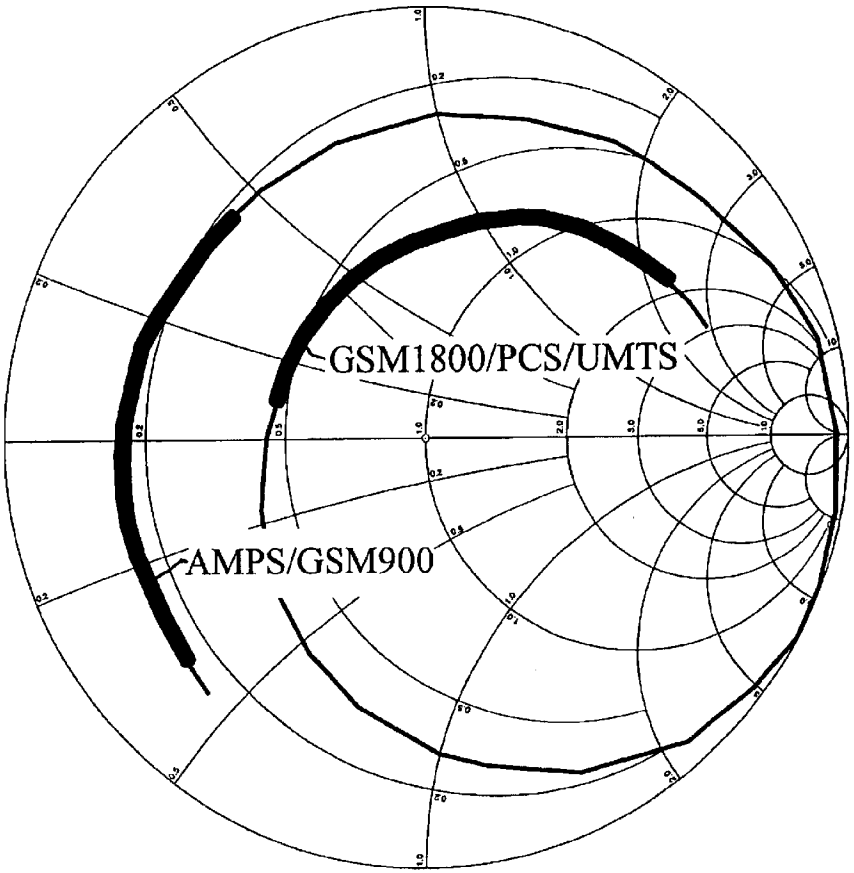
Fig. 7: Impedance of the antenna according to Fig.5

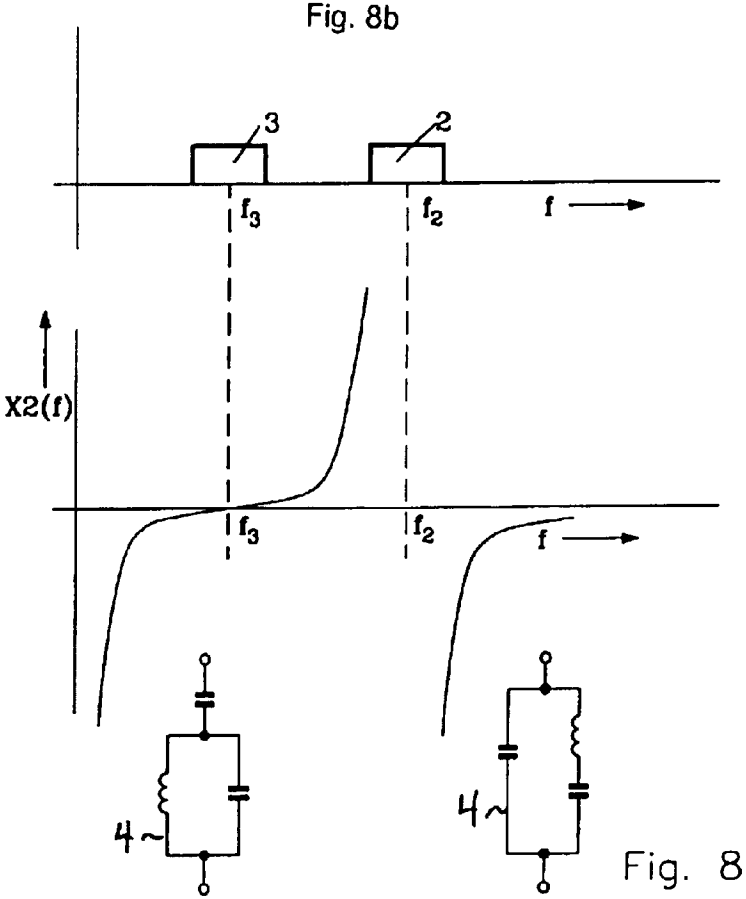
Fig. 8b'
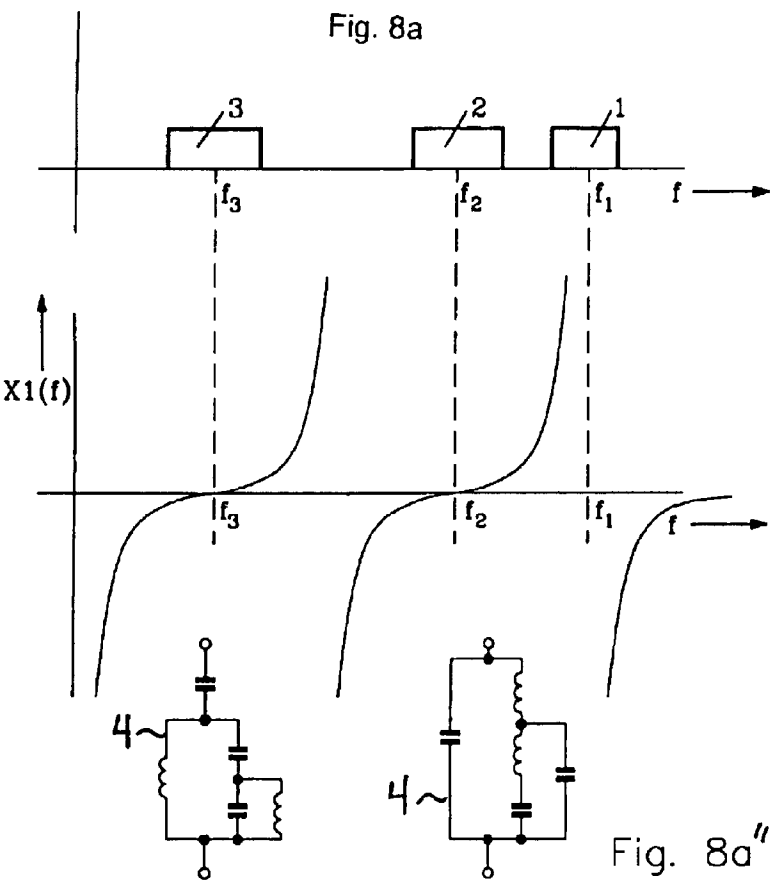
Fig. 8a'
Fig. 8b''
Fig. 8a''

ANTENNA HAVING A MONOPOLE DESIGN, FOR USE IN SEVERAL WIRELESS COMMUNICATION SERVICES

BACKGROUND OF THE INVENTION

1. Field of the Invention

This invention relates to an antenna having a monopole design for at least two wireless communication services consisting of a monopole element 10, structured essentially along a straight line 11.

2. The Prior Art

Monopole antennas for several wireless communication services are known, for example, from U.S. Pat. No. 6,653,982 B2. There, the block diagram of an antenna for several wireless communication services is indicated in FIG. 21*b*. The radiator of the vertical antenna conductor is selected to be sufficiently large for the wireless communication service having the lowest frequency. For the case of a required frequency-selective shortening of the electrically effective wave length for higher wireless channel frequencies, interruption points are inserted in the vertical antenna conductor, i.e. suitable dummy elements to configure the vertical diagram and the foot point impedance. In many cases, however, it is advantageous to select the radiator length so that it is not sufficiently large for the lowest frequency range, but rather uses shortened radiators for several wireless communication services. An antenna having a desired low structural shape for several wireless communication services is indicated in U.S. Pat. No. 6,218,997 B1. This antenna has the disadvantage that because of its shape, which deviates from rotational symmetry, it does not possess a sufficient omnidirectional directional diagram, in terms of azimuth. Furthermore, because of its structural shape, it cannot be used as a communication antenna for several communication services, as shown in U.S. Pat. No. 6,653,982, with the antenna for satellite reception indicated there.

SUMMARY OF THE INVENTION

It is an object of the present invention to provide an antenna, which has a small structural height, while having rotation symmetry properties, and possesses the directional diagram of an electrically short monopole antenna, in the various frequency ranges of the predetermined wireless communication services, and moreover, has an antenna impedance that is advantageous for the impedance adjustment, in each instance.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 6*a* shows a horizontal diagram of an antenna embodiment according to the invention, for the antenna of FIG. 5, at 2300 MHz;

FIG. 6*b* shows a vertical directional diagram of the antenna of FIG. 5 at 2200 MHz;

FIG. 6*c* shows a vertical directional diagram of the antenna of FIG. 5 at 960 MHz;

FIG. 7 shows the impedance diagram of the antenna of FIG. 5;

FIGS. 8*a* and 8*b* show three frequency ranges with respect to the reactances for the associated reactance circuits; and FIGS. 8*a'*, 8*a"*, and 8*b'*, 8*b"* show possible reactance circuits for an antenna of FIG. 2, for three frequency ranges with the frequencies that are fed to them with $f_3$ as the lowest, and $f_1$ as the higher frequency.

DETAILED DESCRIPTION OF THE PREFERRED EMBODIMENTS

Figure 1:
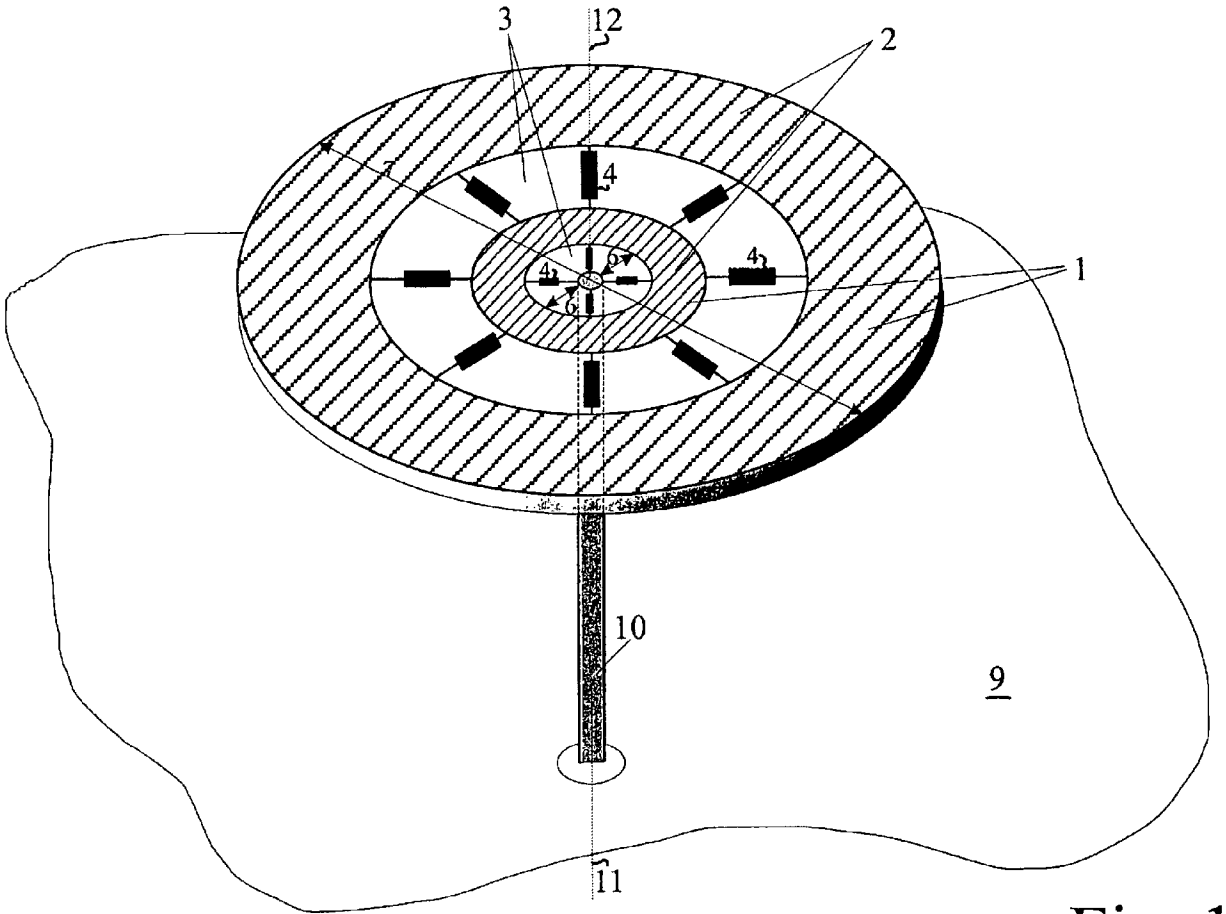
FIG. 1 shows a monopole antenna above a conductive base area in accordance with the present invention.

Referring now in detail to the drawings and, in particular, FIG. 1, a monopole antenna is shown disposed above a conductive base area 9 in accordance with the present invention. In the present example, the roof capacitor 1 consists of two ring structures 2, arranged concentric to one another. The monopole element 10 is connected with an inner ring structure 2' at its top end, by way of reactance circuits 4. The outer ring structure 2 is connected with the inner ring structure 2' by way of other reactance circuits 4. It is advantageous if the reactance circuits 4 are represented by dummy elements 8, the reactance X(f) of which is configured so that the reactance circuits 4 that connect outer ring structure 2 with inner ring structure 2' are accordingly at high impedance in the frequency range of the wireless communication service having the higher frequency, so that outer ring structure 2 is ineffective, to a great extent. In the frequency range of the wireless communication service having the lower frequency, all of the reactance circuits shown in FIG. 1 are sufficiently at low impedance. By means of the arrangement shown, it can be assured, if the outside dimensions 7 of the ring structures 2 and 2' are suitably selected, that the vertical diagram of the monopole antenna, having a roof capacitor 1 in both frequency ranges, corresponds to that of an electrically small radiator. Furthermore, by suitably selecting reactance circuits 4, it can be assured that the impedance at the foot point of the monopole is almost real or non-reactive in both frequency ranges, and that an adjustment can be easily produced.

Depending on the demands on the rotational symmetry of the directional diagrams, reactance circuits 4 are divided up into several individual circuits composed of dummy elements 8, which are uniformly distributed over the circumference of ring structures 2, in an advantageous embodiment of the proposed invention.

Figure 2:
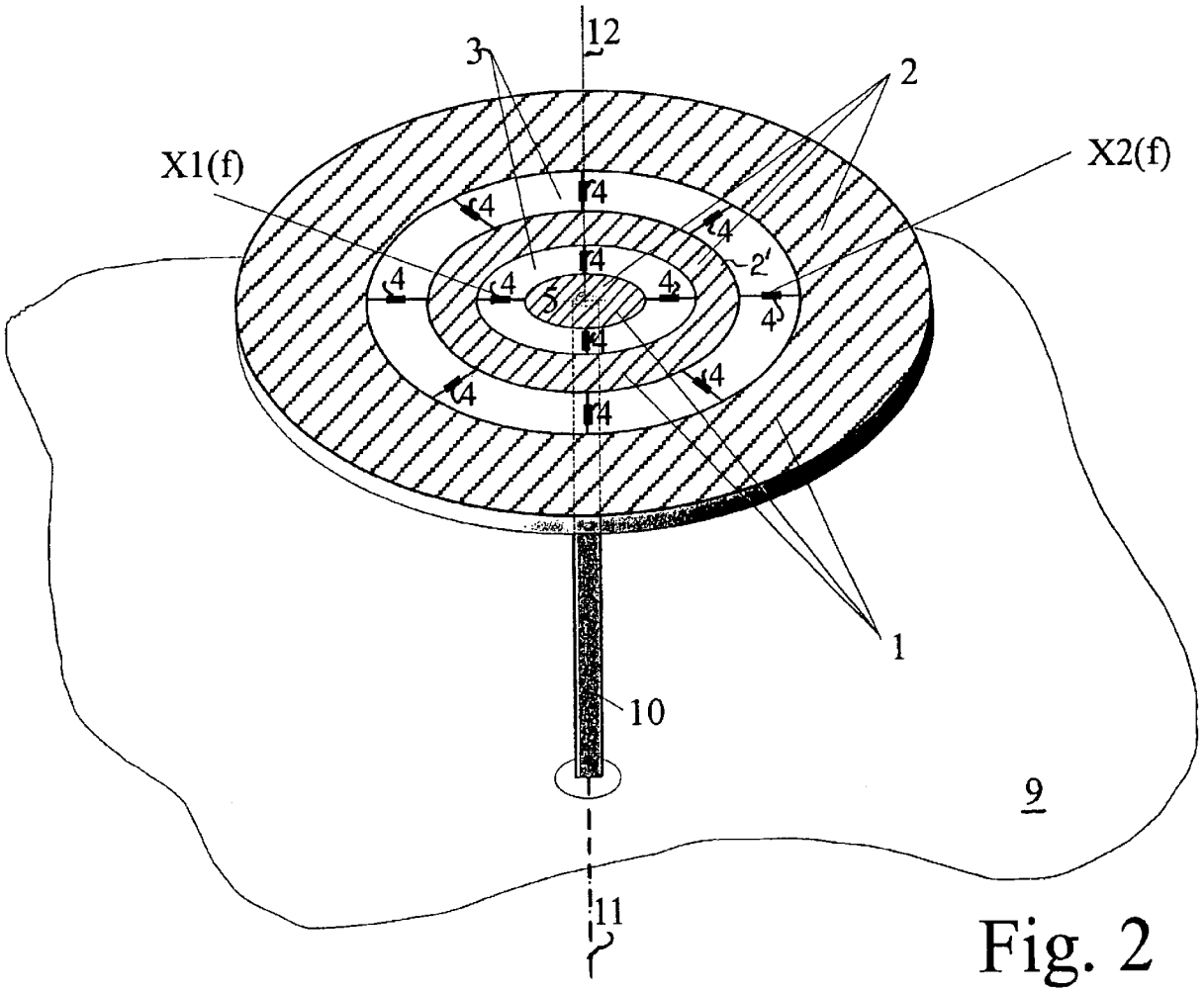
FIG. 2 shows an antenna in which the inside radius of the innermost ring structure is selected to approach zero.

In FIG. 2, the inside radius of the innermost ring structure 2 is selected approaching zero, so that innermost ring structure 2 becomes a circular closed area 5. In the form shown, with two additional ring structures 2, 2' and 2", it is possible, according to the invention, to design the antenna for three frequency ranges, so that it works as an electrically short antenna for all three frequency ranges.

Figure 3:
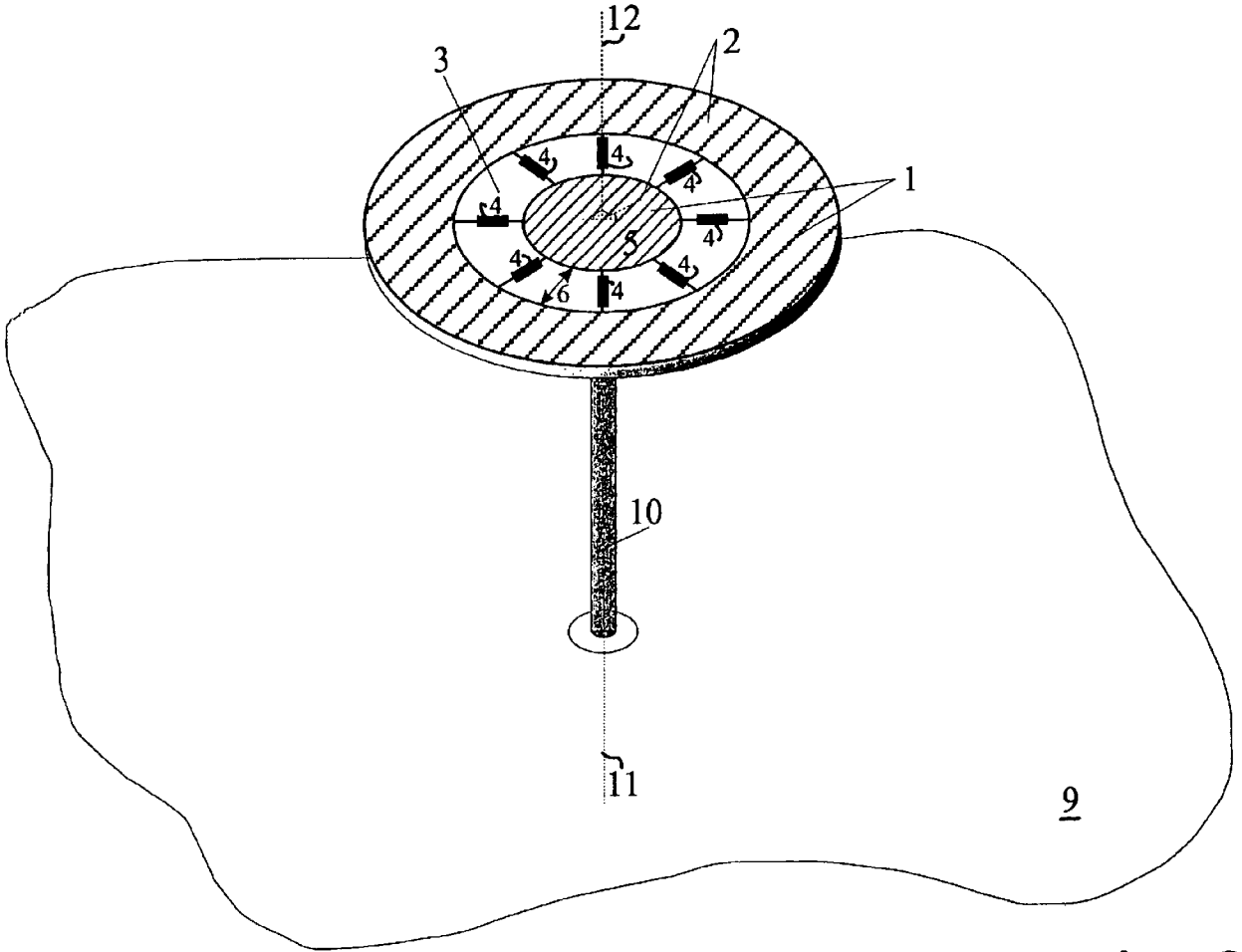
FIG. 3 shows an antenna for use in communication services for two frequency ranges.
Figure 4:
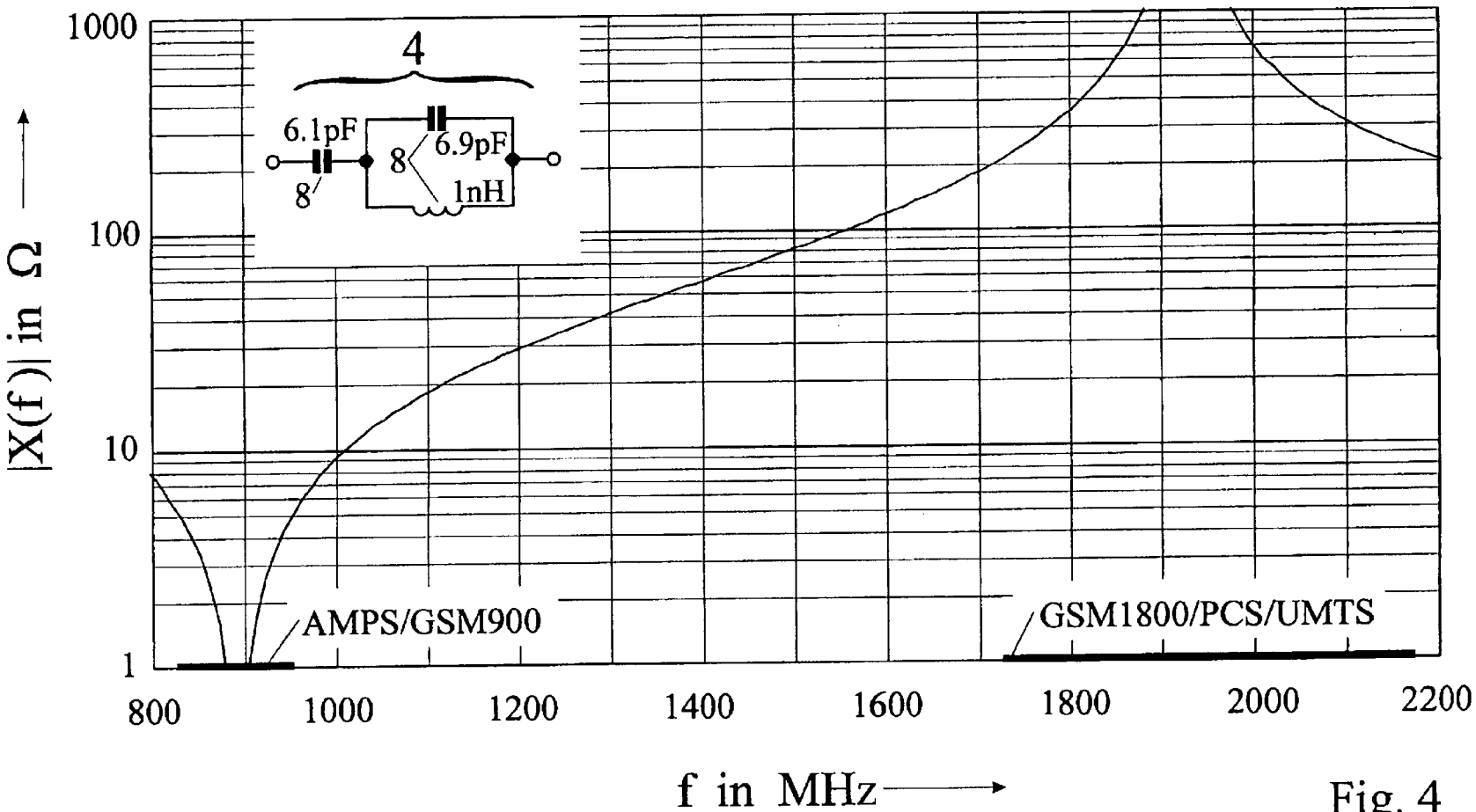
FIG. 4 shows the reactance circuits of FIG. 3 configured in an advantageous manner for a combined coverage of several communication services in one antenna.

An antenna for wireless communication services for two frequency ranges is shown in similar manner in FIG. 3. In the case of a combined coverage of several telephone services in one antenna according to the AMPS/GSM900 standard in a first frequency range of 824 MHz, to 960 MHz and the GSM1800/PCS/UMTS standard in a second frequency range between 1710 MHz and 2170 MHz, reactance circuits 4 in FIG. 3 are configured in advantageous manner as indicated in FIG. 4. The circuit indicated there, composed of dummy elements 8, can be divided up into four reactance circuits 4, for example, so that the reactances shown must be selected to be four times as high in ohms in each individual circuit. This antenna can therefore be used instead of the radiator 20 in FIG. 22 of U.S. Pat. No. 6,653,982 B2, in advantageous manner, because of the given rotational symmetry of the total arrangement, which is a prerequisite for the combination of the satellite function antenna indicated there.

Figure 5:
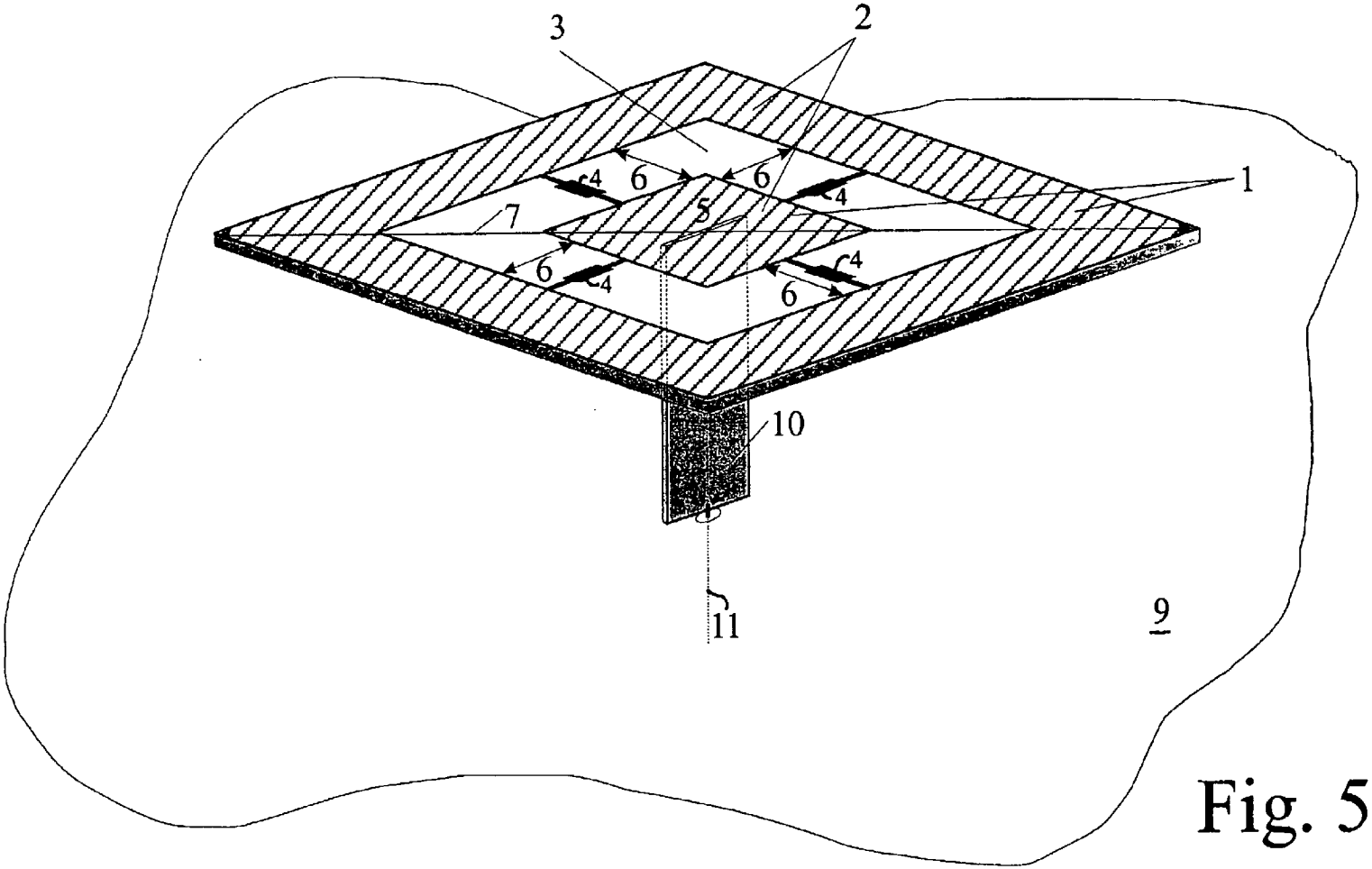
FIG. 5 shows an antenna with a square shaped closed area as the innermost ring structure, and a square shaped outer ring structure.

In the case of a radiator shape according to the invention, the condition of rotational symmetry is fulfilled even if ring structures 2 deviate from a circular structure. This is because of the outside dimension 7 of individual ring structures 2, (which is small in comparison with the wavelength), in combination with the lack of effect of the outer ring structures 2, which are shut off at higher frequencies. This antenna, which is configured, as shown in FIG. 5, with a closed area 5 in square shape as the innermost ring structure 2, and an outer ring structure 2 structured in square shape, has an azimuthal directional diagram, which as shown in FIG. 6*a*. At this frequency, the outside dimension 7 corresponds to a relative length of 5. It turns out, in surprising manner, that because of the high impedance of the reaction circuit 4 in FIG. 5 at the higher frequency, the outer ring structure 2 does not distort the azimuthal diagram. Likewise, it is evident from FIGS. 6*b* and 6*c* that the vertical diagrams in both frequency ranges correspond to those of an electrically short monopole. In FIG. 7, the impedances for both frequency ranges are marked, and show values for which an impedance adjustment can be made in simple manner.

In order to configure the capacitative coupling between the ring structures 2 in a sufficiently advantageous manner, gap width 6 should be selected to be sufficiently large. On the other hand, however, it should be selected not to be so large, that the spatial capacitance of the remaining area of ring structures 2 is not too small.

FIGS. 8*a* and 8*b* show three frequency ranges with respect to the reactances for the associated reactance circuits 4, and FIGS. 8*a*', 8*a*" and 8*b*', 8*b*" show possible reactance circuits 4 for an antenna according to FIG. 2, for three frequency ranges for the frequencies to be received by them, wherein $f_3$ is the lowest, and $f_1$ is the higher frequency. Here, FIG. 8*a* shows the frequency progression of the reactance X1(f) for reactance circuits 4 that are switched between the inner closed area 5 and the subsequent ring structure 2, having low impedance values in the ranges of frequencies 2 and 3, and high impedance values in the highest frequency range 1, to separate the outermost ring structure 2. Analogous to this, FIG. 8*b* shows the frequency progression of the reactance X2(f) for reactance circuit 4 of FIGS. 8*b*' and 8*b*" switched between the outermost and the next inner ring structure 2', having low impedance values in the frequency range $f_3$ and high impedance values in the higher frequency ranges $f_2$ and $f_1$, to separate two outer ring structures.

Accordingly, while only a few embodiments of the present invention have been shown and described, it is obvious that many changes and modifications may be made thereunto without departing from the spirit and scope of the invention.

What is claimed is:

1. A monopole roof antenna, for use with at least two wireless communication services, of different frequencies comprising;

a monopole element structured essentially along a straight line, a roof capacitor that is structured essentially as a flat area, and disposed substantially perpendicular to the straight line, and connected with said monopole element, said roof capacitor being essentially structured with rotation of symmetry, and comprising a plurality of flat ring structures that are separated from one another by ring-shaped gaps of said monopole element, said ring structures being disposed concentric to the straight line, reactance circuits disposed in said ring-shaped gaps and coupled to adjacent ring structures in a frequency-dependent manner, so that all of said flat ring structures are active for a wireless communication service having the lowest frequency, and wherein said outermost ring structure is essentially ineffective for the wireless communication service having the next higher frequency, because of the high impedance of said reactance circuits, and wherein for more than two wireless communication services, the dimension of the outermost of the active ring structures connected with one another by means of the low impedance of said reactance circuit is smaller at a higher frequency of the wireless communication services.

2. The monopole antenna according to claim 1, wherein the inside radius of an innermost ring structure, is selected towards zero, so that the latter is configured as a closed area, and that the latter is connected with said monopole element.

3. The monopole antenna according to claim 2, wherein said closed area is square, and the outer and inner edge of said ring structure are structured to be square, and said ring-shaped gap is sufficiently large and is disposed at a uniform gap width along the circumference of said square ring structure.

4. The monopole antenna according to claim 3, wherein said roof capacitor has different dimensions in the lengthwise and crosswise direction, due to its design requirement, and that the ratio of the lengthwise to crosswise dimension is not greater than 3.

5. The monopole antenna according to claim 2, wherein said closed area and all the edges of said ring structures are configured to be circular and concentric, and said ring-shaped gap is structured with a uniform gap width along the circumference of said circular ring structures.

6. The monopole antenna according to claim 1, wherein the inside radius of an innermost ring structure is configured with a gap width and wherein at least one of said reactance circuits defines the connection between said innermost ring structure and said monopole element.

7. The monopole antenna according to claim 6, wherein said gap width is selected, on the one hand, to be sufficiently large so that the capacitative coupling between said ring structures is sufficiently small, and on the other hand, is selected not to be too large, so that the spatial capacitance of the remaining area of said ring structures is not too small.

8. The monopole antenna according to claim 1, wherein said reactance circuits are composed of a plurality of dummy elements that are selected so that all of the ring structures that contribute to the formation of the active roof capacitor in the frequency range of one of the wireless communication services are connected at low impedance with said monopole element, by way of the chain of said reactance circuits in this frequency range.

9. The monopole antenna according to claim 8, for the wireless communication services AMPS/GSM900 in a first frequency range, and the wireless communication services GSM1800/PCS/UMTS in a second frequency range, wherein said roof capacitor contains a closed area and a ring structure that surrounds the former, and that said reactance circuits comprise a plurality of dummy elements, so that the reactance X(f) contains a pole in the higher second frequency range, and is at sufficiently high impedance, and possesses a zero point in the lower first frequency range, and is at sufficiently low impedance.

10. The monopole antenna according to claim 1, wherein in order to improve the rotational symmetry of the arrangement, several of said reactance circuits are uniformly connected in parallel to the circumference of the ring structures, the parallel electrical effect forming a sufficiently great reactance X(f) for the higher frequency ranges, which is at sufficiently low impedance to turn on the next outer ring at the lower frequencies.

* * * * *